United States Patent [19]

Moltrasio

[11] 4,311,228

[45] Jan. 19, 1982

[54] AUTOMATIC FEEDER FOR EMPTY BAGS OR THE LIKE

[76] Inventor: Mario Moltrasio, Viale Vittorio Emanuele, 34, Bergamo, Italy

[21] Appl. No.: 64,285

[22] Filed: Aug. 6, 1979

[30] Foreign Application Priority Data

Jul. 28, 1978 [IT] Italy ..... 26250 A/78

[51] Int. Cl.[3] ..... B65G 47/26

[52] U.S. Cl. ..... 198/422; 198/484; 198/796; 198/801; 414/121

[58] Field of Search ..... 414/29, 47, 46, 121, 414/416; 198/484, 796, 801, 422

[56] References Cited

U.S. PATENT DOCUMENTS 3,991,685 11/1976 Toby ..... 198/796 X 4,024,963 5/1977 Hautau ..... 414/121 X

*Primary Examiner*—Andres Kashnikow

*Attorney, Agent, or Firm*—Guido Modiano; Albert Josif

[57] ABSTRACT

Automatic feeder for empty bags comprises a carousel type accumulator having a plurality of containers, each container being capable of containing bags either singularly or in stacks. The containers are conveyed by the carousel type accumulator along an annular path. A supplying station for the bags and a discharging station therefor are arranged in such path. Extraction mechanisms capable of detecting the containers when they are filled act thereon in the discharging station for extracting the bags. Suckers and a conveyor tape transfer singularly the extracted bags towards a successive working station.

7 Claims, 6 Drawing Figures

AUTOMATIC FEEDER FOR EMPTY BAGS OR THE LIKE

BACKGROUND OF THE INVENTION

This invention relates to an automatic feeder for empty bags or the like, particularly designed for the supply of bag filling machines.

As it is known the presently existing bag filling machines effect automatically and relatively swiftly their work after the bags to be filled have been supplied thereto. Sufficiently automatic devices for feeding the bags singularly or in packs to these machines have heretofore not been available. The bag filling machine may in certain cases be provided with component parts which are adapted to position and to mouth the bags, but at present such bags have to be fed to the bag filling machine by an operator. It is thus necessary that at best the bags are supplied continuously by an operator and exactly positioned in respect to the bag filling machine which then conveys and fills the supplied bags.

Such an operation not only increases the operational costs owing to the high cost of the man power, but introduces decisively the human factor in the working cycle so that any interruption or delay whatsoever in the feeding of the bags depending on such human factor may cause a stoppage or a delay in the entire subsequent working chain.

SUMMARY OF THE INVENTION

An object of this invention is to remove the above shortcomings and to solve the technical problem involved in the obtainement of a wholly automatic bag feeder and which may be linked up to the presently known bag filling machines.

The invention envisages further to make is possible that the said feeder is not only supplied with singular bags or stacks of bags, but is also practically insensible in respect of a supply of desultory type, the feeder performing also the function of an accumulator of bags to be filled.

The invention envisages further to make it possible to provide a simple automatic feeder capable to ensure a continuous and reliable operation.

According to one aspect of the invention there is provided an automatic feeder for empty bags or the like, characterized in that it comprises a carousel type accumulator having a plurality of containers, each of said containers being capable of containing bags either singularly or in stacks, said containers being conveyed by said carousel type accumulator along an annular path, at least one supplying station for the bags and at least one discharging station therefor both arranged in the said path, extraction mechanisms capable of detecting said containers when they are filled and to act thereon in said discharging station for extracting the bags, as well as conveying means for transferring singularly the extracted bags towards a successive working station.

BRIEF DESCRIPTION OF THE DRAWINGS

The features and advantages of the invention will appear more fully from the following description of a preferred embodiment of the invention, shown by way of example in the accompanying drawing in which.

DESCRIPTION OF THE PREFERRED EMBODIMENTS

Figure 2:
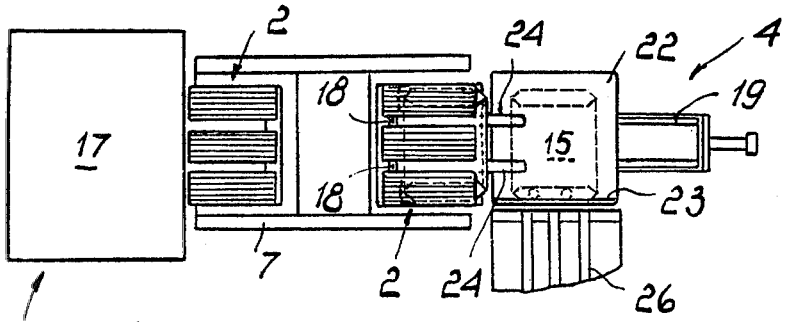
FIG. 2 shows a plain view of FIG. 1.

With reference to the drawing, the automatic feeder according to the invention comprises a vertical carousel accumulator 1 having containers 2 which are carried by the carousel accumulator 1 along an annular path, the accumulator further comprising a suplying station 3 for the bags, a discharging station 4 for the bags, extractor members 5 adapted to act only in respect of filled containers 2 and conveying means 6 for the discharged or unloaded bags.

Figure 1:
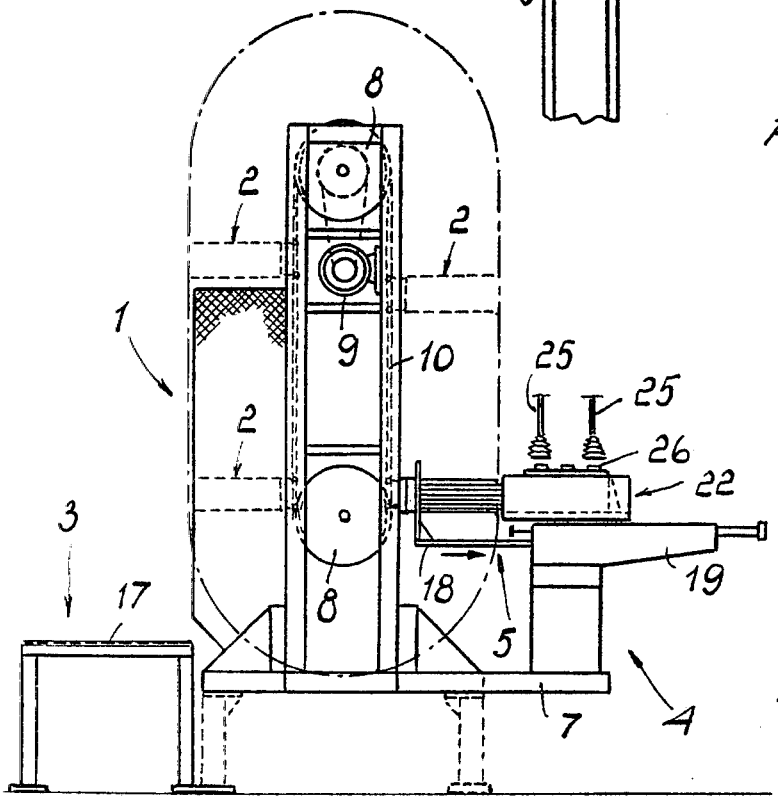
FIG. 1 shows diagrammatically the feeder.
Figure 4:
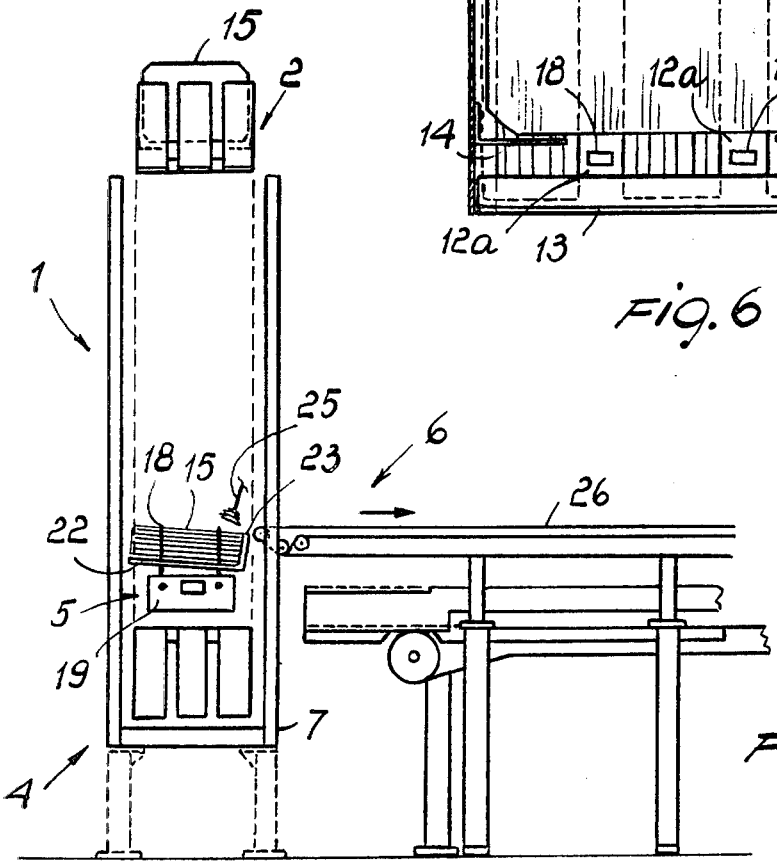
FIG. 4 is a view of the feeder perpendicular to that of FIG. 1.

In detail, the carousel accumulator 1 shown particularly in FIGS. 1 and 4 is constituted of a frame 7 extending according to a ring in the vertical direction. It comprises further in its central portion roundabout wheels 8 one of which is driven by a motor 9. Running between the roundabout wheels 9 is a chain 10 provided with per se known means, such as hooks or the like, not shown, and adapted to support the containers 2 at one end thereof.

Figure 5:
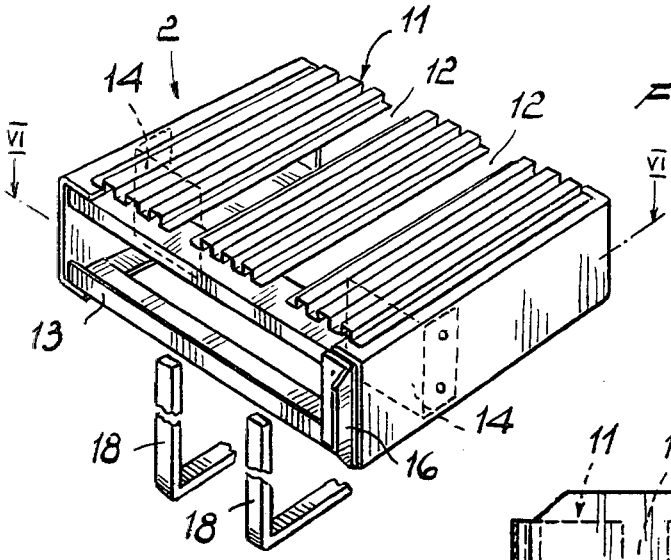
FIG. 5 shows in perspective view with some parts removed, a component part of the feeder according to the invention.
Figure 6:
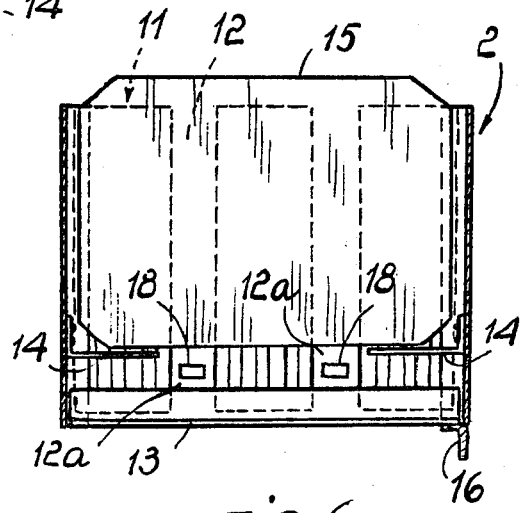
FIG. 6 shows a section and in a plain view the component part of FIG. 5, the section being taken along the line VI—VI of FIG. 5.

The containers 2 are shown in FIGS. 5 and 6. They have a pocket like shape capable to contain a stack of bags 15 inserted therein through an open mouth 11. The containers are further provided with slits 12 which extend into the mouth 11, such slits extending over horizontal sides thereof when the said mouth lies in vertical plane. Another feature of the containers 2 should be envisaged in the presence of two bottoms on the side opposite to the mouth 11: a first bottom 13 defining the outside bottom of every container, and a second bottom 14 or internal bottom arranged between the mouth 11 and the outside bottom 13 and having the function to limit the maximum insertion depths of the bags 15. The inner bottom 14 is defined by simple brackets which do not extend over the slits 12. As shown in FIG. 6, even if the bags 15 are fully inserted, nevertheless, by virtue of the internal bottom 14, a clearance **12*a* remains free in the slits 12**.

In the shown embodiment of the containers are advantageously made of C-sections and of L-sections and of corrugated sheets, so as to ensure the required strength with the minimum weight.

Fixed on the external bottom 13 is a cam 16. Furthermore, fixed on the external bottom 13 are also junctions for the chain 10, which are not illustrated but which may be of any known kind whatsoever.

On one side of the carousel accumulator 1 a supplying or loading station 3 for the bags is provided, which may be simply formed by a support 17 for the storage of the bags 15. Provided on the opposite side is a discharging or unloading station 4 for the bags. By virtue of the engagement of the containers 2 with the chain 10 and by virtue of the annular outline of the same, the containers 2 have always their mouth 11 turned towards the loading station 3 and the unloading station 4.

Figure 3:
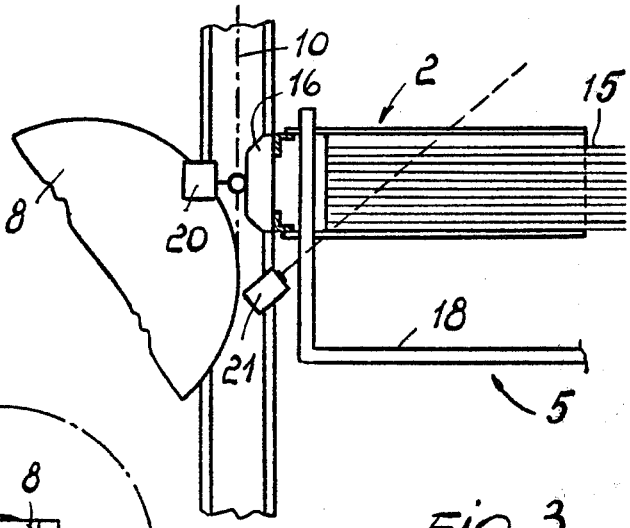
FIG. 3 shows a detail of FIG. 1 in an enlarged scale.

Provided at the discharging station 4 are extracting members 5 capable to detect those containers 2 which are filled up with the bags 15 and capable to act for the purpose of extracting in a lump the said bags. As visible in FIG. 3 the said members 5 comprise hackle elements 18, which are driven by a driving mechanism 19 and which are inserted with their vertical portions or pins into the clearance 12*a* of the slits 12. The hackle elements 18 are sized so as to be adapted to pass through the slits 12 when there are no bags 15 in the containers 12.

A stoppage mechanisms for the containers 12 is provided near the hackle elements 18. This stoppage mechanism is actuated by additional component parts of the extracting members 5, i.e. by a microswitch 20 arranged to cooperate with the mentioned cam 16 and an optical sensor 21 which detects the presence or the absence of the bags 15 within the containers and, if the bags are present, it actuates the stoppage when the microswitch 20, which is stationary, is actuated by the cam 16 of the container 2 which has been detected as a filled container.

Adjacent the extracting member 5, in line with the container 2 which has been stopped for the extraction of the bags 15, is a dwelling platform 22 provided with a side wall 23 for the abutment and positioning of the bags (FIGS. 2 and 4). This platform is provided with grooves 24 which extend beyond the slits 12 of the dwelling container and which allow the hackle elements 18 to be inserted therein for a certain length.

The said conveying means 6 comprise for example suckers 25 and a conveyor tape 26, which are capable singularly to transfer the bags 15 from the dwelling platform 22 towards a subsequent working station, for example a filling station for the bags.

The operation of the feeder according to the invention is as follows.

The bags 15, grouped preferably in stacks or packs, are inserted by an operator into the containers 2 which move frontally past the loading station 3. The loading may take place also in a desultory or irregular manner, as will be explained hereinafter. The containers 2, partly filled and partly empty, which are provided closely adjacent to each other and in a great number on the roundabout accumulator 1, are brought by means of the latter towards the unloading station 4. Once reached this station they successively actuate with the cam 16 the microswitch 20, which determines the position of their possible stoppage for the unloading purposes. The stoppages takes place only if the containers 2 which acts on the microswitch 20 is filled with bags, as is visible in FIG. 3 and as detected by the optical sensor 21. Otherwise the containers 2 are not stopped and in continuing their movement the still-standing hackle elements 18 pass therethrough by virtue of the slits 12 where the pins of the hackles 18 pass through. When the containers 2 are instead filled with bags 15, the hackle elements 18 would not have the possibility to pass therethrough, but the possibility exists that the vertical portion or pins of the hackle elements 18 are inserted into the clearances 12*a* of the slits 12, as is shown for example in FIG. 3. Once the clearances 12*a* are engaged, the microswitch 20 and the optical sensor 21 cause the stoppage of the chain 10 and consequently the movement of the containers 2 in such a way that that container 2 which finds itself in the unloading stage assumes a position in which its lower face is level with the dwelling platform 22. The hackle elements 18 are hence moved by the driving unit 19 towards the dwelling platform 22 thereby bringing the bags 15 thereonto and being partially inserted into the grooves 24 of the said platform.

FIG. 4 shows how the bags on the dwelling platform 22 are caused to laterally lean against the sidewall 23 in view of the fact that the supporting surface for the bags is inclined towards said sidewall.

At this point starts the action of the conveyor means 6, which by means of the suckers 25 rise the bags 15 one by one in order to place them onto the conveyor 26 which directs the bags 15 towards any subsequent working whatsoever, for example towards a filling stage.

It is evident that the feeder according to the invention may correctly operate also in case in which there is an alternate of a casual kind of the filled and empty containers, since the empty containers 2 do not slow down the rythm of the roundabout accumulator 1. Furthermore, it will be evident that the stage which requires the greatest performance time is the terminal one, in which the suckers 25 are operating. The rotational speed of the carousel accumulator 1 may, in such case, be regulated as a function depending on the working speed of the conveyor means 6, with the consequence that the supply of the containers 2 towards the loading station 3 is particularly facilitated and may be carried out also in desultory manner since the speed of advancement of the containers 2 is not particularly high.

The invention attends thus the objects set out. In fact, as explained, the feeder is practically insensible to desultory interruptions of the supply of bags and performs efficiently the accumulating or storing function. Furthermore the devices carried out are extremely simple but functional and highly reliable.

In practice the materials used and the dimensions selected may be anyone depending on the requirements.

I claim:

1. An automatic feeder for empty bags or the like, characterized in that it comprises a carousel type accumulator having a plurality of containers, each of said containers being capable of containing bags either singularly or in stacks, said containers being conveyed by said carousel type accumulator along an annular path, at least one supplying station for the bags and at least one discharging station therefor both arranged in the said path, extraction mechanisms capable of detecting said containers when they are filled and act thereon in said discharging station for extracting the bags, as well as conveying means for transferring singularly the extracted bags towards a successive working station, wherein each said containers has a mouth for the introduction of said bags, an outside bottom on the opposite side in respect of said mouth, and an intermediate inner bottom provided between said outside bottom and said mouth, arranged to limit the maximum introduction of the bags therein and in that two opposite walls of the lateral surface of each container and said inner bottom are provided with slits which define together passages extending throughout each container in accordance with its direction of movement on said carousel accumulator.

2. A feeder according to claim 1, characterized in that said extraction mechanisms comprise hackle elements having a size and being positioned to pass through said containers at said slits and having terminal portions extending perpendicular to said slits and insertable into the clearances thereof provided between said outside and inner bottom.

3. A feeder according to claims 1 or 2, characterized in that said extraction mechanisms comprise a switch arranged to be actuated by said containers and positioned at said discharging station, as well as a sensor arranged to detect if said containers are filled, said switch and said sensor actuating the stoppage of said carousel accumulator and the action of said hackle elements only if both of them are energized.

4. A feeder according to claim 3, characterized in that said switch is a microswitch arranged to be actuated by a cam projecting from each said containers and in that said sensor is an optical sensor looking through said slits.

5. A feeder according to claim 2, characterized in that said hackle elements are movable in a direction parallel to said slits, from said clearance towards and beyond said mouth upon the action of a driving unit connected thereto.

6. A feeder according to claim 5, characterized in that provided adjacent the mouth of said containers, in the unloaded position, is a dwelling platform whereon said bags are transferred by said hackle elements and in that said dwelling platform is jointed by said conveyor means.

7. A feeder according to claim 6, characterized in that said conveyor means comprise a tape conveyor and suckers arranged to engage that bag which is in the position of the maximum level on said dwelling platform and to carry it onto said tape conveyor.

* * * * *